US006783424B2

(12) United States Patent
Choi

(10) Patent No.: US 6,783,424 B2
(45) Date of Patent: Aug. 31, 2004

(54) POSABLE PLUSH TOY FIGURE

(75) Inventor: Ok Soo Choi, Los Angeles, CA (US)

(73) Assignee: Mattel, INC, El Segundo, CA (US)

( * ) Notice: Subject to any disclaimer, the term of this patent is extended or adjusted under 35 U.S.C. 154(b) by 0 days.

(21) Appl. No.: 10/611,615

(22) Filed: Jun. 30, 2003

(65) Prior Publication Data

US 2004/0077277 A1 Apr. 22, 2004

Related U.S. Application Data

(63) Continuation of application No. 10/159,668, filed on May 31, 2002, now Pat. No. 6,612,896.

(51) Int. Cl.[7] ..... A63H 3/02
(52) U.S. Cl. ..... 446/370; 446/373; 446/382
(58) Field of Search ..... 446/370, 373–375, 446/382

(56) References Cited

U.S. PATENT DOCUMENTS 2,396,654 A * 3/1946 Herrmann ..... 446/370
3,284,947 A * 11/1966 Dahl ..... 446/374
3,624,691 A * 11/1971 Robson et al. ..... 446/374
3,955,309 A * 5/1976 Noble ..... 446/370
4,964,836 A * 10/1990 Kamei ..... 446/374

* cited by examiner

*Primary Examiner*—Jacob K. Ackun
*Assistant Examiner*—Bena B. Miller
(74) *Attorney, Agent, or Firm*—Roy A. Ekstrand

(57) ABSTRACT

A toy figure body formed as a four legged animal includes an outer skin and interior padding to assume an animal-like form. Within the front legs and feet of the animal body a front leg armature passed upwardly from the animal's feet through the front legs and across the lower portion of the body. A rear leg armature separate from the front leg armature extends upwardly from the animals feet through the rear legs and passes therebetween through the animal's body. A tail armature extends from with padded animal body outwardly to support a posable tail. In an alternate embodiment, the three separate armatures are covered with a fabric sleeve.

3 Claims, 3 Drawing Sheets

POSABLE PLUSH TOY FIGURE

CROSS REFERENCE TO RELATED PATENT APPLICATIONS

This application is a continuation of application Ser. No. 10/159,668 filed May 31, 2002, now U.S. Pat. No. 6,612, 896, entitled POSABLE PLUSH TOY FIGURE having the same applicant.

FIELD OF THE INVENTION

This invention relates generally to dolls and toy figures and particularly to those known generally in the art as "plush figures".

BACKGROUND OF THE INVENTION

Posable toy figures are well known in the art and for many years have been provided in a variety of shapes, sizes, configurations and materials. While substantial variation is present in posable toy figures and dolls, basically dolls and toy figures are designated as being posable when they exhibit the property of having the capability of being bent or shaped by the user to configurations, postures or poses which the doll or toy figures then maintains after release by the user. A certain amount of posability may be achieved in dolls and toy figures by selecting fabrication materials which are known to exhibit a characteristic malleability and ductility. When formed of such material, dolls and toy figures tend to maintain any shape imposed upon them. A substantial number of newly developed plastic materials suitable for use in molding dolls and toy figures have been developed which posses this malleability and ductility.

Other posable dolls and toy figures acquire the posability through fabrication of relatively rigid components which are joined by articulated joints. Posability arises in the provision of restriction of movement or friction within the figures joints allowing the figure to maintain a posed position. Achieving posability in this manner requires what is, in essence, an interference fit between joint components or some other friction mechanism.

For the most part however, not withstanding the foregoing types of posable figures, practitioner's in the art usually achieve posability by combining a ductile or malleable armature which is supported within a covering body formed of a flexible resilient material such as molded plastic or rubber or the like. In such figures, the posability or maintenance of a given pose is provided by the strength and ductility of the armature which resists the tendency of the molded body covering to return to its original position.

Plush toys and dolls, so named because of their soft padded bodies, are often difficult to provide in a posable fabrication. In a typical plush toy or doll, the body is formed of a flexible fabric outer covering which is stuffed with a resilient padding material. In practice, the use of a malleable or ductile armature within such plush padded figures is subject to several difficulties. For example, the typical plush material padding used in doll's or toy figures often interferes with flexing or bending of the armature material itself. Another problem arises as the padding material moves during posing and allows the armature to move within the padded interior of the toy figure thereby shifting the armature rather than bending it as desired.

There arises therefore a continuing need in the art for improved posable plush toy figures which readily accommodate a malleable ductile armature within the padded interior for optimum posing.

SUMMARY OF THE INVENTION

Accordingly, it is a general object of the present invention to provide an improved posable plush toy figure. It is a more particular object of the present invention to provide an improved posable plush toy figure which supports an armature within the padded figure interior in a manner facilitating posability. It is a still more particular object of the present invention to provide an improved posable plush toy figure having a malleable internal armature which maintains accurate positioning within the toy figure interior.

In accordance with the present invention there is provided a posable plush toy figure comprising: a figure body having a flexible outer skin and a padded body filled with padding material, the body including front legs, front feet, rear legs and rear feet; a front leg armature formed of a ductile material having front foot loops within the front feet and extending upwardly through the front legs and passing through the body; and a rear leg armature, separate from and independent of the front leg armature, formed of a ductile material having rear foot loops within the rear feet and extending upwardly through the rear legs and passing through the body, the front leg armature and the rear leg armature being tightly surrounded by the padding material within the front and rear legs and feet respectively and the front leg armature and the rear leg armature being posable independent of each other.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
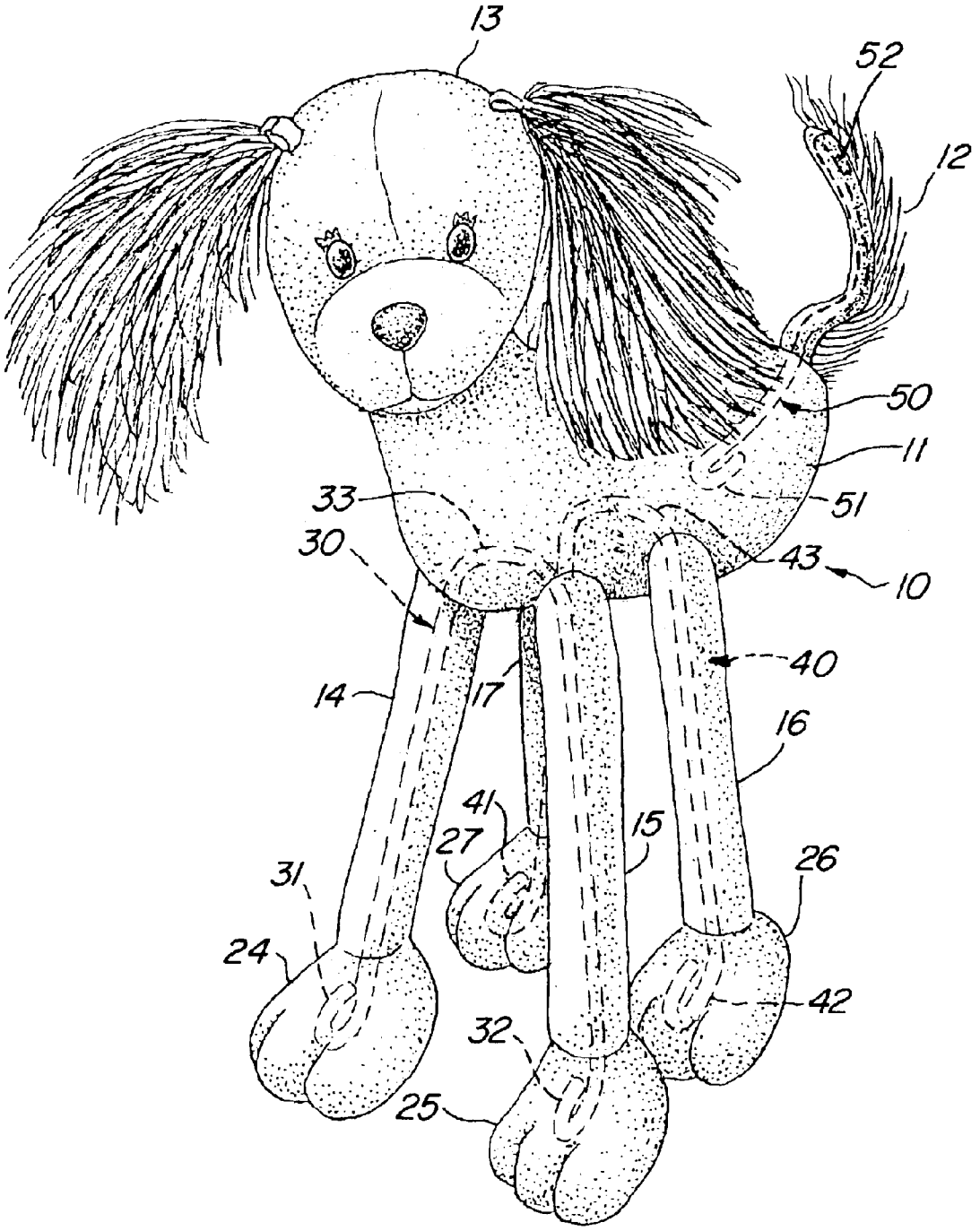
FIG. 1 sets forth a front perspective view of a posable plush toy figure constructed in accordance with the present invention.

FIG. 1 sets forth a front perspective view of a posable plush toy figure constructed in accordance with the present invention and generally referenced by numeral 10. Toy FIG. 10 is shown in FIG. 1 in a standing pose having its four legs supporting the figures weight and having the figures tail and head raised to a normal standing position.

More specifically, posable plush toy FIG. 10 includes a body 11 supporting a tail 12 and a head 13. Body 11 is in turn supported by a quartet of legs 14, 15, 16 and 17. Legs 14 through 17 are in turn supported by a plurality of feet 24, 25, 26 and 27 respectively. Body 11, tail 12, head 13, as well as legs 14 through 17 and feet 24 through 27 are fabricated of a soft outer fabric skin which is preferably flexible together with an interior supply of relatively densely packed padding material. The attachment between the elements forming the outer skin of toy FIG. 10 is carried forward using conventional attachment such as sewing stitches or the like. In accordance with the present invention, toy FIG. 10 further includes a front leg armature 30, a rear leg armature 40, and a tail armature 50. Armatures 30, 40 and 50 are preferable formed of a malleable ductile material such as soft metal or the like. Front leg armature 30 includes portions extending downwardly through legs 14 and 15 into feet 24 and 25. Within feet 24 and 25, front leg armature 30 is formed into foot loops 31 and 32 respectively. Front leg armature 30 further includes an upper bend portion 33 extending between legs 14 and 15 and passing through the lower portion of body 11.

Rear leg armature 40 extends downwardly through legs 16 and 17 into feet 26 and 27 forming foot loops 42 and 41 respectively therein. In a similar fabrication to front leg armature 30, rear leg armature 40 includes an upper bend 43 passing between legs 16 and 17 and through the lower portion of body 11.

Tail armature 50 includes an outer end 52 supported within tail 12 and an interior loop 51 formed within body 11. Tail armature 50 extends upwardly from loop 51 through body 11 and tail 12 to outer end 52 and provides posable support for tail 12.

In accordance with the preferred fabrication of the present invention, front leg armature 30, rear leg armature 40 and tail armature 50 are each formed of single length of malleable ductile metal or other material. Thus, armatures 30, 40 and 50 may be fabricated using presently available materials such as soft copper or soft iron as well as other materials having the desired malleability and ductility.

As mentioned, FIG. 1 shows posable plush toy FIG. 10 in a standing position. It will be apparent to those skilled in the art that in accordance with the present invention, toy FIG. 10 may be posed by bending legs 14 through 17 as well as tail 12 in a typical posing play pattern. It will be noted that the use of loops 31 and 32 within feet 24 and 25 as well as loops 41 and 42 within feet 27 and 26 together with loop 51 within body 11 provides secure anchoring and positional stability for armatures 30, 40 and 50 within the present invention toy figure. As is set forth below in greater detail, and in accordance with an important aspect of the present invention, the packing or padding material utilized within the interior of toy FIG. 10 is preferably packed in substantial density about armatures 30, 40 and 50 with particular attention being paid to the density about loops 31, 32, 41, 42 and 51 to maintain the secure positioning of armatures 30, 40 and 50.

In accordance with a further advantage of the present invention, toy FIG. 10 utilizes separate unconnected armatures for the front legs, rear legs and tail. It has been found that the avoidance of junction material between the leg and tail armatures greatly improves the posability performance of a plush toy figure. This contravenes conventional armature design in which a single armature having all appendage supports coupled thereto is utilized within the toy figure. Thus, each individual armature is able to maintain its own position and stress load during posing. This has been found particularly advantageous for the fabrication of a padded plush toy figure.

Figure 2:
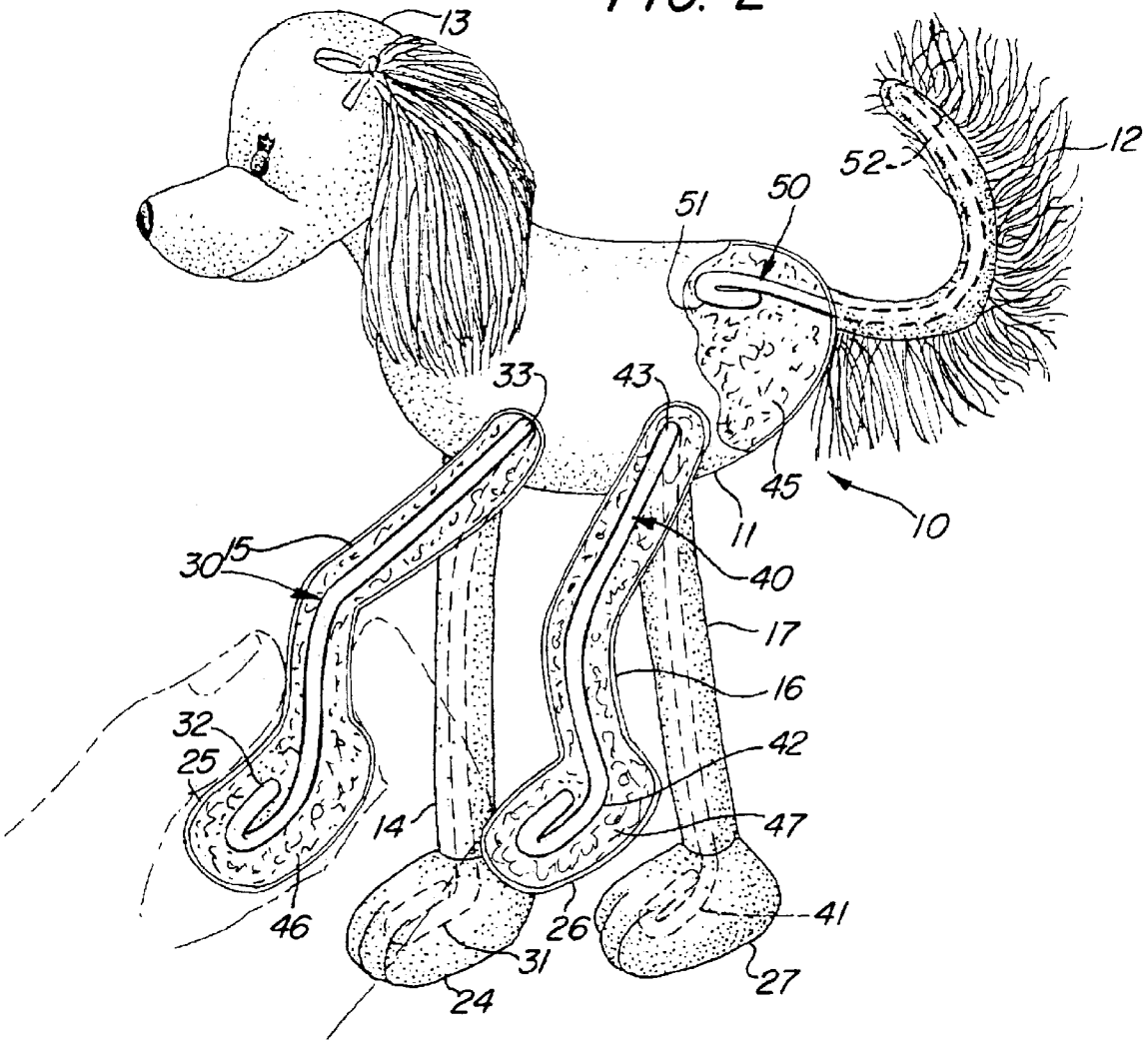
FIG. 2 sets forth a partially sectioned side elevation view of a posable plush toy figure constructed in accordance with the present invention.

FIG. 2 sets forth a partial section side elevation view of the present invention toy figure once again generally referenced by numeral 10. In FIG. 2, toy FIG. 10 is shown having legs 14 through 17 posed in a walking position. Similarly, tail 12 is shown posed in an upwardly and forwardly curved pose position. As is indicated by the dash line phantom drawing of the user's hand applied to leg 15, this posing is achieved by simply bending leg 15 or other appendages of FIG. 10. The ductile material of armature 30 within leg 15 maintains the posed position.

More specifically, posable plush toy FIG. 10 includes a body 11 supporting a tail 12 and a head 13. Body 11 is in turn supported by a quartet of legs 14, 15, 16 and 17. Legs 14 through 17 are in turn supported by a plurality of feet 24, 25, 26 and 27 respectively. Body 11, tail 12, head 13, as well as legs 14 through 17 and feet 24 through 27 are fabricated of a soft outer fabric skin which is preferably flexible together with an interior supply of relatively densely packed padding material. The attachment between the elements forming the outer skin of toy FIG. 10 is carried forward using conventional attachment such as sewing stitches or the like., In accordance with the present invention, toy FIG. 10 further includes a front leg armature 30, a rear leg armature 40, and a tail armature 50. Armatures 30, 40 and 50 are preferable formed of a malleable ductile material such as soft metal or the like. Front leg armature 30 includes portions extending downwardly through legs 14 and 15 into feet 24 and 25. Within feet 24 and 25, front leg armature 30 is formed into foot loops 31 and 32 respectively. Front leg armature 30 further includes an upper bend portion 33 extending between legs 14 and 15 and passing through the lower portion of body 11.

Rear leg armature 40 extends downwardly through legs 16 and 17 into feet 26 and 27 forming foot loops 42 and 41 respectively therein. In a similar fabrication to front leg armature 30, rear leg armature 40 includes an upper bend 43 passing between legs 16 and 17 and through the lower portion of body 11.

Tail armature 50 includes an outer end 52 supported within tail 12 and an interior loop 51 formed within body 11. Tail armature 50 extends upwardly from loop 51 through body 11 and tail 12 to outer end 52 and provides posable support for tail 12.

In accordance with the preferred fabrication of the present invention, front leg armature 30, rear leg armature 40 and tail armature 50 are each formed of single length of malleable ductile metal or other material. Thus, armatures 30, 40 and 50 may be fabricated using presently available materials such as soft copper or soft iron as well as other materials having the desired malleability and ductility.

As mentioned above, the interior of FIG. 10 is padded with a stuffing or padding material utilized in filling out the form of FIG. 10 and in accordance with the present invention situated to assist in the positioning and support of armatures 30, 40 and 50. Thus, within front legs 14 and 15, front leg armature 30 is supported by a quantity of padding 46 which completely and preferably tightly fills legs 14 and 15 as well as feet 24 and 25. The secure positioning of padding material 46 about armature 30 provides substantial advantage for toy FIG. 10. Similarly, a padding material 47 is tightly packed within legs 16 and 17 as well as feet 26 and 27 to maintain the positioning of rear leg armature 16. Finally, a quantity of padding 45 fills body 11 and tightly surrounds loop 51 and the interior portion of tail armature 50 to provide secure attachment within body 11.

Figure 3:
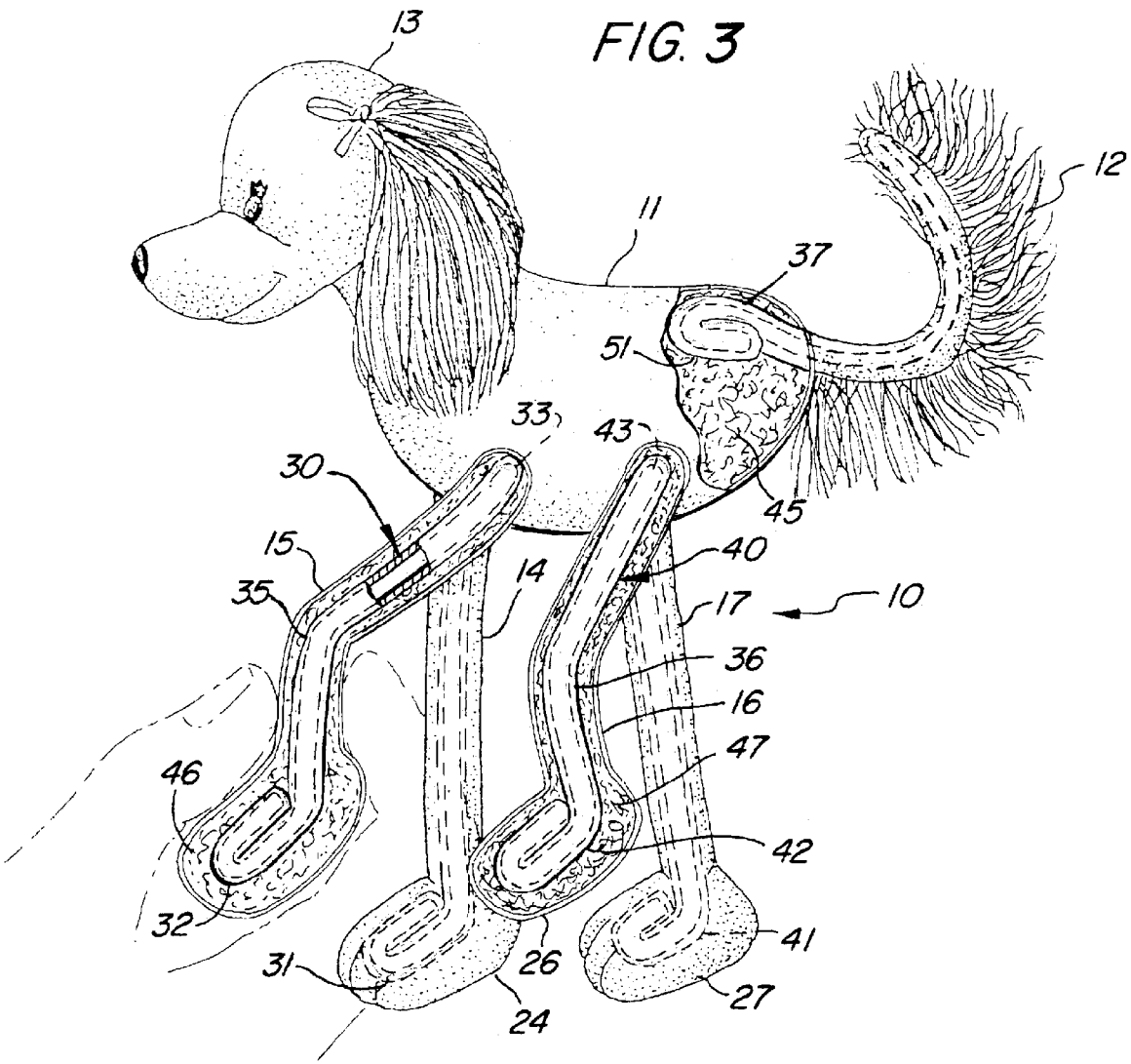
FIG. 3 sets forth a partially sectioned side elevation view of an alternate embodiment of the present invention posable plush toy figure.

FIG. 3 sets forth a partially sectioned side elevation view of an alternate embodiment of the present invention toy figure still generally referenced as FIG. 10. FIG. 3 is substantially identical to the embodiment of FIG. 2 with the addition of fabric sleeves 35, 36 and 37 upon armatures 30, 40 and 50 respectively. It has been found that the use of fabric sleeve armatures, formed of a material such as cotton or cotton percale substantially improves the support and posability of the armatures within a plush toy figure padded environment.

More specifically, posable plush toy FIG. 10 includes a body 11 supporting a tail 12 and a head 13. Body 11 is in turn supported by a quartet of legs 14, 15, 16 and 17. Legs 14 through 17 are in turn supported by a plurality of feet 24, 25, 26 and 27 respectively. Body 11, tail 12, head 13, as well as legs 14 through 17 and feet 24 through 27 are fabricated of a soft outer fabric skin which is preferably flexible together with an interior supply of relatively densely packed padding material. The attachment between the elements forming the outer skin of toy FIG. 10 is carried forward using conventional attachment such as sewing stitches or the like. In accordance with the present invention, toy FIG. 10 further includes a front leg armature 30, a rear leg armature 40, and a tail armature 50. Armatures 30, 40 and 50 are preferable formed of a malleable ductile material such as soft metal or the like. Front leg armature 30 includes portions extending downwardly through legs 14 and 15 into feet 24 and 25. Within feet 24 and 25, front leg armature 30 is formed into foot loops 31 and 32 respectively. Front leg armature 30 further includes an upper bend portion 33 extending between legs 14 and 15 and passing through the lower portion of body 11.

Rear leg armature 40 extends downwardly through legs 16 and 17 into feet 26 and 27 forming foot loops 42 and 41 respectively therein. In a similar fabrication to front leg armature 30, rear leg armature 40 includes an upper bend 43 passing between legs 16 and 17 and through the lower portion of body 11.

Tail armature 50 includes an outer end 52 supported within tail 12 and an interior loop 51 formed within body 11. Tail armature 50 extends upwardly from loop 51 through body 11 and tail 12 to outer end 52 and provides posable support for tail 12.

In accordance with the preferred fabrication of the present invention, front leg armature 30, rear leg armature 40 and tail armature 50 are each formed of single length of malleable ductile metal or other material. Thus, armatures 30, 40 and 50 may be fabricated using presently available materials such as soft copper or soft iron as well as other materials having the desired malleability and ductility.

As mentioned above, the interior of FIG. 10 is padded with a stuffing or padding material utilized in filling out the form of FIG. 10 and in accordance with the present invention situated to assist in the positioning and support of armatures 30, 40 and 50. Thus, within front legs 14 and 15, front leg armature 30 is supported by a quantity of padding 46 which completely and preferably tightly fills legs 14 and 15 as well as feet 24 and 25. The secure positioning of padding material 46 about armature 30 provides substantial advantage for toy FIG. 10. Similarly, a padding material 47 is tightly packed within legs 16 and 17 as well as feet 26 and 27 to maintain the positioning of rear leg armature 16. Finally, a quantity of padding 45 fills body 11 and tightly surrounds loop 51 and the interior portion of tail armature 50 to provide secure attachment within body 11.

As described above, armature 30 further includes a fabric sleeve 35 which completely covers armature 30. Fabric sleeve 35 cooperates with padding 46 to allow flexing of armature 30 without allowing armature 30 to move through the material of padding 46. Similarly, a fabric sleeve 36 completely covers armature 40 and provides corresponding benefits to those described for armature 30 and fabric sleeve 35. Finally, a fabric sleeve 37 completely covers armature 50 and provides the associated benefits described for armature 30 and fabric sleeve 35.

It has been found that the use of fabric sleeves about the individual armatures of the present invention posable toy figure provides substantial improvement over armatures not utilizing the fabric sleeve.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

What is claimed is:

1. A posable plush toy figure comprising:

a figure body having a flexible outer skin and a padded body filled with padding material, said body including front legs, front feet, rear legs and rear feet;

a front leg armature formed of a ductile material having front foot loops within said front feet and extending upwardly through said front legs and passing through said body; and a rear leg armature, separate from and independent of said front leg armature, formed of a ductile material having rear foot loops within said rear feet and extending upwardly through said rear legs and passing through said body, said front leg armature and said rear leg armature being tightly surrounded by said padding material within said front and rear legs and feet respectively and said front leg armature and said rear leg armature being posable independent of each other, and wherein said front leg armature includes a front armature sleeve formed of a flexible fabric tube enclosing said front leg armature, said front armature sleeve being \interposed between said front leg armature and said padding material.

2. The posable plush toy figure set forth in claim 1 wherein said rear leg armature includes a rear armature sleeve formed of a flexible fabric tube enclosing said rear leg armature, said rear armature sleeve being interposed between said rear leg armature and said passing material.

3. The posable plush toy figure set forth in claim 1 wherein said rear leg armature includes a rear armature sleeve formed of a flexible fabric tube enclosing said rear leg armature, said rear armature sleeve being interposed between said rear leg armature and said passing material.

* * * * *